United States Patent [19]

Satoh et al.

[11] Patent Number: 5,052,831

[45] Date of Patent: Oct. 1, 1991

[54] DEVICE FOR EXACT REGISTRATION OF MONOCHROME IMAGES OF A COLOR REPRODUCTION IN A THERMAL INK TRANSFER PRINTER

[75] Inventors: Seiji Satoh, Iwai; Osamu Tajima, Ibaraki, both of Japan

[73] Assignee: Victor Company of Japan, Ltd., Yokohama, Japan

[21] Appl. No.: 573,577

[22] Filed: Aug. 27, 1990

[30] Foreign Application Priority Data

| | | | |
|---|---|---|---|
| Aug. 29, 1989 | [JP] | Japan | 1-220351 |
| Aug. 30, 1989 | [JP] | Japan | 1-223467 |
| Aug. 31, 1989 | [JP] | Japan | 1-226160 |

[51] Int. Cl.[5] ..... B41J 3/20

[52] U.S. Cl. ..... 400/120; 400/630; 400/632

[58] Field of Search ..... 400/120, 636, 636.1, 400/636.2, 637, 638, 639–639.1, 642, 645, 645.5, 622, 630, 631, 632, 633, 240.3

[56] References Cited

U.S. PATENT DOCUMENTS

| | | | |
|---|---|---|---|
| 4,552,470 | 11/1985 | Yawa et al. | 400/637 |
| 4,625,218 | 11/1986 | Watanabe | 400/120 |

FOREIGN PATENT DOCUMENTS

| | | | |
|---|---|---|---|
| 2716396 | 10/1978 | Fed. Rep. of Germany | 400/632 |
| 2946033 | 5/1981 | Fed. Rep. of Germany | 400/631 |
| 0066989 | 4/1982 | Japan | 400/631 |
| 0138965 | 8/1982 | Japan | 400/639.1 |
| 64-87281 | 3/1989 | Japan . | |

OTHER PUBLICATIONS

"Gate, Stackers and Rear Feed Rolls Actuation" IBM Technical Disclosure Bulletin, vol. 19, No. 3, 8/76, pp. 748–749.

*Primary Examiner*—Eugene H. Eickholt

*Attorney, Agent, or Firm*—Fleit, Jacobson, Cohn, Price, Holman & Stern

[57] ABSTRACT

A color printer for thermally transferring a set of monochrome images of each desired color reproduction from a color transfer strip to a recipient sheet as the latter is fed back and forth by and past a platen roll disposed intermediate a sheet loading cassette and a sheet unloading cassette. The printer additionally comprises a thermal printing head for pressing the transfer strip, in superposition with each recipient sheet fed from the loading cassette, against the platen roll for thermal ink transfer, and a pinch roller disposed upstream of the printing head, with respect to the traveling direction of the recipient sheet from the loading cassette to the unloading cassette, for pressing the recipient sheet against the platen roll. For more precise registration of the monochrome images of each color reproduction, a retractable end abutment is disposed between printing head and pinch roller. The recipient sheet stands endwise on the end abutment before being fed forwardly past the platen roll for the transfer of each monochrome image. A lateral sheet readjustment mechanism is disposed upstream of the end abutment for readjusting the lateral position of the recipient sheet, standing endwise on the end abutment, with respect to the platen roll.

11 Claims, 12 Drawing Sheets

DEVICE FOR EXACT REGISTRATION OF MONOCHROME IMAGES OF A COLOR REPRODUCTION IN A THERMAL INK TRANSFER PRINTER

BACKGROUND OF THE INVENTION

This invention relates to a printer, particularly a color printer, operating on the principle of thermal ink transfer, such that ink is thermally transferred from ink transfer sheet to ink recipient sheet. More particularly, this invention concerns means in such a printer for automatically readjusting the position of the recipient sheet with a view to the enhancement of the registration or alignment of a plurality (normally three or four) of monochrome images of each color reproduction.

The thermal ink transfer printer has won extensive commercial acceptance as a compact color printing device. Among the primary reasons for this popularity are the simplicity in construction, fast printing speed, and ease of handling of the printer, as well as the high resolution and the multiple tone gradations of the printings obtained.

Basically, in the printer of this type, each recipient sheet from an insertable cassette is printed upon while being pressed against a platen roll by the thermal printing head via an elongate strip of transfer sheet. The printing head has a plurality of electric heater elements which are aligned lengthwise of the platen roll. The electric current fed to the heater elements is controlled for printing dots on the recipient sheet line by line with the incremental rotation of the platen roll.

For color printing, a color transfer strip is employed which bears on its different longitudinal sections the inks of the three primary colors, yellow, magenta and cyan. A black ink may also be used to add detail and contrast to the printed reproduction, as is well known in the printing art. The ink of a first preselected color is first transferred from the color transfer strip to the recipient sheet while the latter is traveling forwardly past the platen roll in superposition with the required ink section of the color transfer strip. Then the recipient sheet is fed back by the platen roll in coaction with a pinch roller pressing the sheet against the roll. Then the recipient sheet is fed forward for the transfer of the ink of a second preselected color from the transfer strip to the recipient sheet. The same procedure is repeated on the same recipient sheet until the three or four monochrome images of the desired color reproduction are all formed in register on the recipient sheet.

There has been a problem left unsolved in the color printer of this type with regard to the registration of the set of monochrome images of each color reproduction. The problem arises from the fact that the recipient sheet must be fed back and forth past the platen roll several times for each color reproduction. The pinch roller has so far been held pressing the recipient sheet against the platen roll during all such repeated reciprocation of the recipient sheet. Moreover, the recipient sheet has been fed back at a speed several times higher than that during printing, with a view to the reduction of the total time of printing for each color reproduction.

For all these reasons the recipient sheet has tended to develop undulations, particularly with load fluctuations on the platen drive motor. Further the recipient sheet has been easy to become displaced with respect to the platen roll because of unavoidable variations in the cylindricity and the dimensional and positional accuracy of the platen and pinch roller. The displacement of the recipient has also been liable to occur from variable degrees of frictional resistance imposed thereon with respect to the transverse direction of the recipient sheet.

Thus, conventionally, the set of monochrome images of each color reproduction have sometimes been printed out of register with one another. The degree of color registration has been subject to change from one reproduction to another, to the impairment of the reliability of the color ink transfer printer.

It might be contemplated, for example, to manufacture the platen, pinch roller and other associated means to closer dimensional tolerances, and to assemble them with greater positional accuracy, than heretofore. This solution would be impractical because such parts must be made of elastic material and so are susceptible to deformation. The color printer itself would also become much more difficult of manufacture and expensive in construction.

SUMMARY OF THE INVENTION

The present invention aims at the enhancement of the registration of the set of monochrome images of each color reproduction in a thermal ink transfer printer of the kind defined, without any major alteration of the existing parts of the device.

Briefly, the present invention may be summarized as a color printer wherein a set of monochrome images of a desired color reproduction are thermally transferred from a color transfer strip to a recipient sheet as the latter is fed back and forth by and past a platen roll disposed intermediate a sheet loading station and a sheet unloading station. The printer additionally includes a thermal printing head for pressing the transfer strip and the recipient sheet in superposition against the platen roll for thermal ink transfer, and a pinch roller movable toward and away from the platen roll for pressing the recipient sheet against the platen roll. The pinch roller is spaced upstream from the printing head with respect to the traveling direction of the recipient sheet from the loading station to the unloading station.

Characteristically, the invention provides means in such a color printer for the exact registration of the monochrome images of each color reproduction on the recipient sheet, comprising an end abutment disposed intermediate the printing head and the pinch roller for reciprocating movement between a working position close to the platen roll and a retracted position away from the platen roll. The working position of the retractable end abutment is such that the recipient sheet can be made to stand endwise thereon by gravity, with the pinch roller held spaced from the platen roll, preparatory to being fed forwardly past the platen roll for the transfer of each monochrome image. Also included is a sheet readjustment mechanism disposed upstream of the end abutment for readjusting the lateral position of the recipient sheet, standing endwise on the end abutment with respect to the platen roll.

The sheet readjustment mechanism may comprise sheet guide means defining at least part of a path for the recipient sheet between the loading station and the platen roll, a side abutment disposed on one side of the sheet guide means and extending at a right angle to the end abutment, and a sheet pusher disposed on the other side of the sheet guide means for pushing the recipient sheet, standing endwise on the end abutment, into neat contact with the side abutment.

Thus the recipient sheet can be exactly repositioned with respect to the platen roll preparatory to the printing of each monochrome image of a desired color reproduction thereon. The precise registration of the monochrome images is therefore possible without the need for manufacture of the platen roll, pinch roller and other related parts to too stringent tolerances.

The readjustment of the recipient sheet according to the invention makes it necessary for the recipient sheet completely released from between platen and pinch roller. It is therefore desirable that the platen roll be also readjusted to the same angular position before the recipient sheet is subsequently pressed against the same by the pinch roller, as will be taught in more detail in the preferred embodiments of the invention disclosed herein.

According to a further feature of the invention, means are provided for stretching the recipient sheet being pressed against the platen roll just before the printing of each monochrome image. Still higher color registration can be accomplished as the recipient sheet is thus made absolutely free from any slack. The recipient sheet may be stretched either upstream or downstream of the platen roll.

The above and other features and advantages of this invention and the manner of realizing them will become more apparent, and the invention itself will best be understood, from a study of the following description and appended claims, with reference had to the attached drawings showing some preferred embodiments of the invention.

DESCRIPTION OF THE PREFERRED EMBODIMENTS

Figure 1:
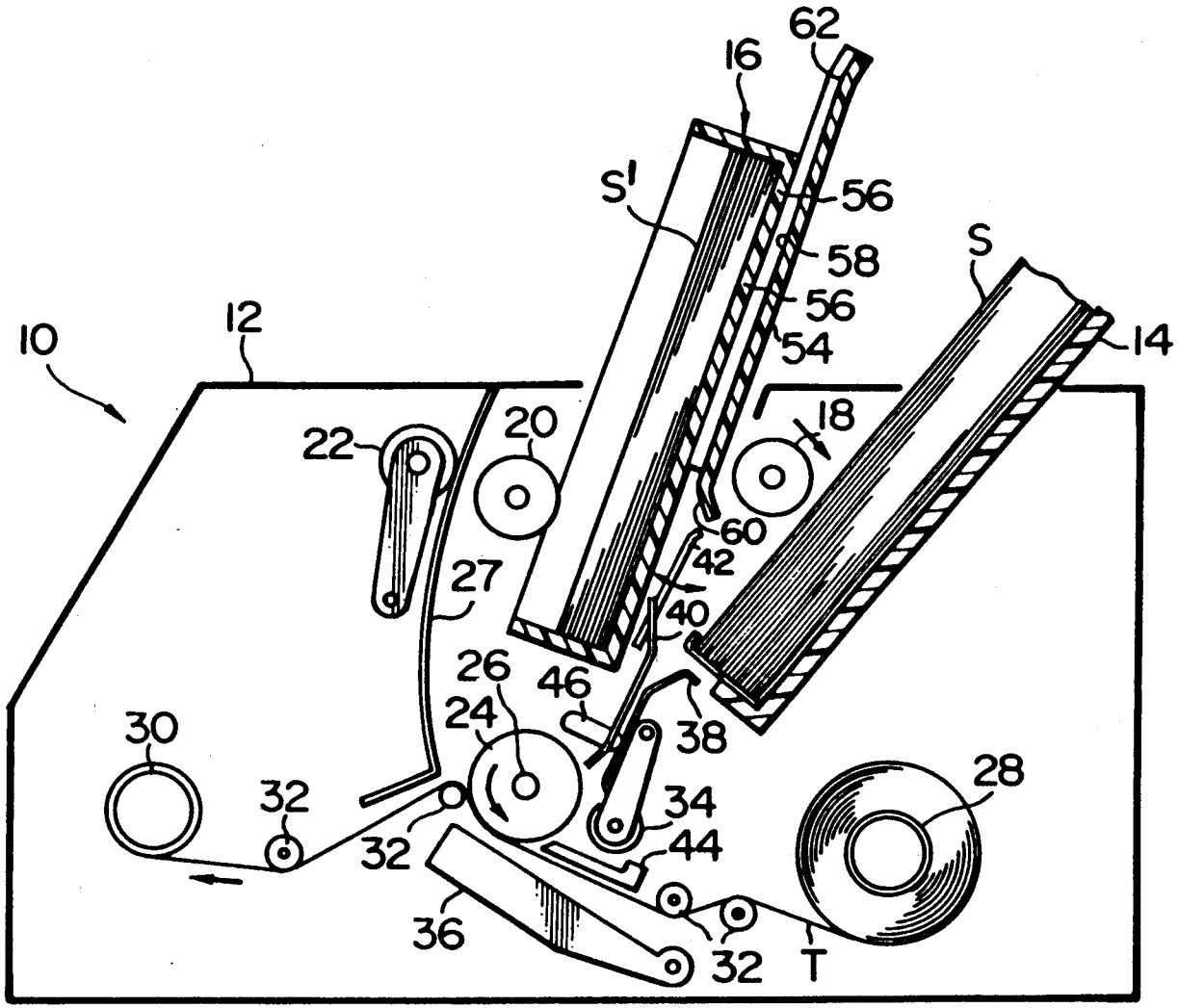
FIG. 1 is a vertical section, partly in elevation, through the thermal ink transfer color printer constructed in accordance with the novel concepts of the present invention, the printer being herein shown with its various working parts initialized.

The color printer embodying the principles of this invention is generally designated 10 and shown in different stages of operation in FIGS. 1–4. The following description of construction will be understood by referring mostly to only FIG. 1 which depicts the normal state of the printer 10.

The improved color printer 10 has a casing 12 in which a sheet loading cassette 14 and a sheet unloading cassette 16 may be removably mounted at suitable angles. Both cassettes 14 and 16 are of boxlike, open top construction. The sheet loading cassette 14 holds a stack of recipient sheets S to be printed upon. The sheet unloading cassette 16 is for receiving successive recipient sheets S' that have been printed upon. The loading cassette 14 and the unloading cassette 16 are shown disposed at an acute angle to each other, with the open top of the loading cassette 14 directed somewhat toward the bottom of the unloading cassette 16. Functionally speaking, the loading cassette 14 may be thought of as a sheet loading station of the color printer 10, and the unloading cassette 16 as an unloading station.

Figure 2:
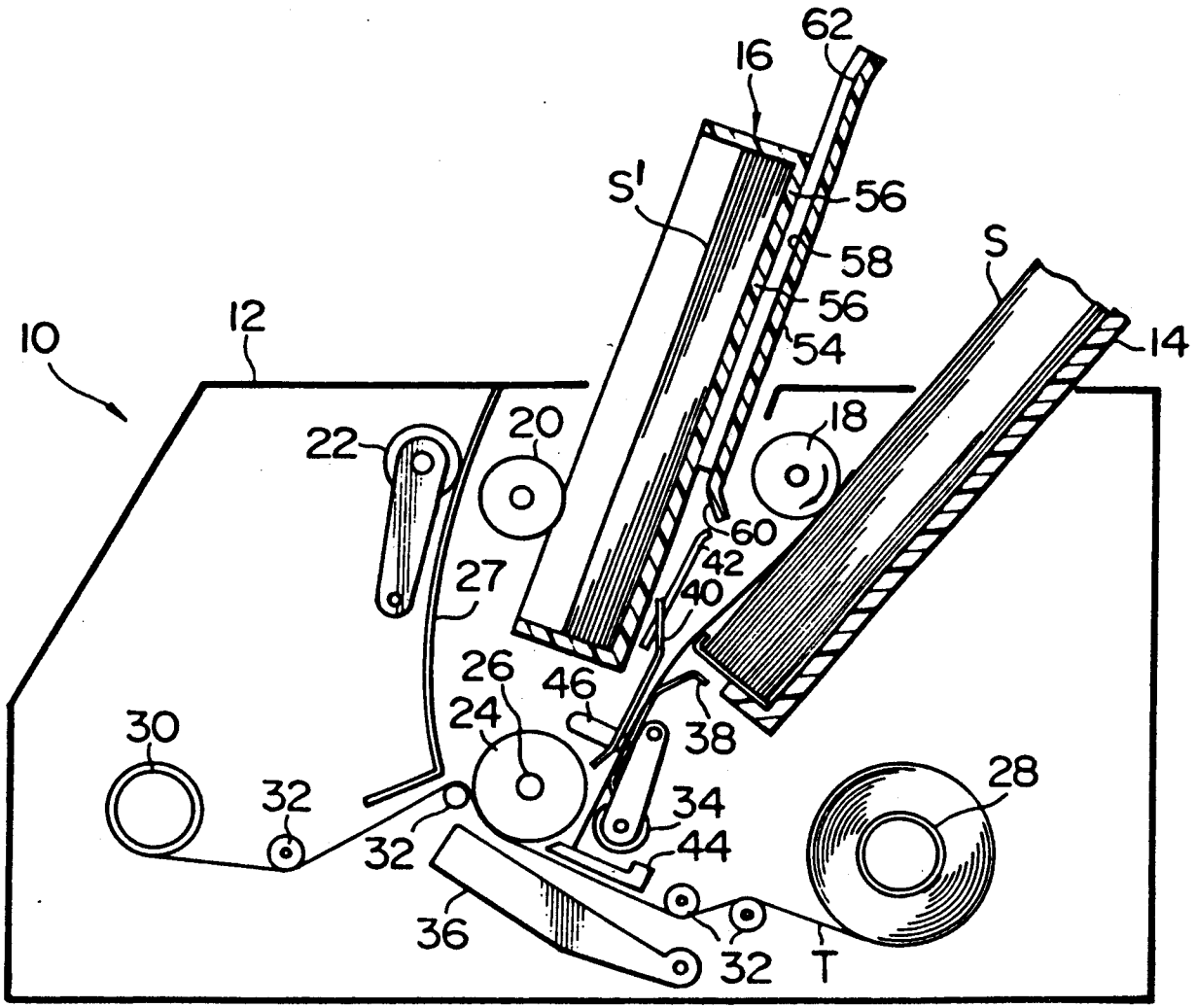
FIGS. 2, 3 and 4 are views similar to FIG. 1 but showing the printer in different steps of operations.

Mounted adjacent the loading cassette 14, a loading roller 18 is not only rotatable about its own axis but also, as will be understood by referring also to FIG. 2, movable into and out of frictional engagement with the stack of recipient sheets S within the loading cassette. The loading roller 18 functions to withdraw the recipient sheets S one by one from within the loading cassette 14 and to feed them along a predefined printing path within the casing 12. A pair of unloading rollers 20 and 22 are disposed adjacent the unloading cassette 16 for introducing the successive printed recipient sheets S' into the unloading cassette 16. The unloading roller 20 is motor driven for rotation in a predetermined direction whereas the other unloading roller 22 is movable into and out of frictional contact with the roll 20 via each printed recipient sheet S.

A platen roll 24 is rotatably mounted approximately centrally within the casing 12 via a rotatable shaft 26. A reversible electric motor, not shown, is coupled to the shaft 26 for bidirectionally driving the platen roll 24. An arcuate sheet guide 27 defines a sheet path from platen roll 24 to unloading cassette 16.

Extending past the platen roll 24 is an elongate strip or web of color transfer sheet T which will be hereinafter referred to as the transfer strip. The transfer strip T has a series of ink zones of different colors arranged repetitively throughout its length. Typical ink colors are yellow, magenta and cyan, possibly plus black. The transfer strip T has its opposite extremities anchored to a supply reel 28 and a takeup reel 30. A suitable number of guide rollers 32 are arranged between supply reel 28 and takeup reel 30 for holding the transfer strip T against the platen roll 24 under tension. It is understood that the takeup reel 30 is motor driven for intermittently pulling the transfer strip T to the left, as seen in FIG. 1, in a manner well timed with the progress of printing operation.

A pinch roller 34 is mounted opposite the platen roll 24. As will be seen by referring also to FIG. 3, the pinch roller 34 is not only rotatable but also movable into and out of forced contact with the platen roll 24 for pressing each recipient sheet S against the platen roll during printing. It will be seen ti the recipient sheet S being printed upon travels between platen roll 24 and transfer strip T. A thermal printing head 36 is pivotally mounted opposite the platen roll 24 for pressing a superposition of the transfer strip T and recipient sheet S against the platen roll.

A pair of opposed sheet guides 38 and 40 are fixedly mounted along the path of each recipient sheet S between loading cassette 14 and platen roll 24. The sheet guides 38 and 40 extend parallel to each other, with a spacing therebetween just sufficient for the recipient sheet S to travel slidingly therethrough. Another sheet guide 42 is pivotally mounted between loading cassette 14 and unloading cassette 16. Pivoted from its normal position of FIGS. 1–3 to a working position of FIG. 4, the movable sheet guide 42 defines part of a return path for the recipient sheet S being printed upon, as will be explained subsequently in more detail.

Constituting a feature of the present invention is a retractable end abutment 44 disposed immediately upstream of the platen roll 24 with respect to the predetermined traveling direction of the successive recipient sheets S from loading cassette 14 to unloading cassette 16. Preferably, and as shown, the end abutment 44 is disposed between pinch roller 34 and printing head 36. Generally flat in shape, the end abutment 44 is laid in a plane parallel to the axes of the platen roll 24 and pinch roller 34 and is movable in this plane between a working position of FIGS. 1 and 2 and a retracted position of FIGS. 3 and 4. The end abutment 44 when in the working position is held so close to the platen roll 24 that, on being fed toward the platen roll from the loading cassette 14, each recipient sheet S is to temporarily butt and stand endwise on the surface of the end abutment, as pictured in FIG. 2, before being pressed against the platen roll 24 by the pinch roller 34.

A lateral sheet readjustment mechanism 46 is provided upstream of the retractable abutment 44 for readjusting the position of the recipient sheet S, standing endwise on the retractable end abutment 44, in the axial direction of the platen roll 24. The end abutment 44 and the readjustment mechanism 46 coact to exactly reposition the recipient sheet S with respect to the platen roll 24 before the sheet becomes pressed against the platen roll by the pinch roller 34, as will become better understood as the description proceeds.

Figure 5:
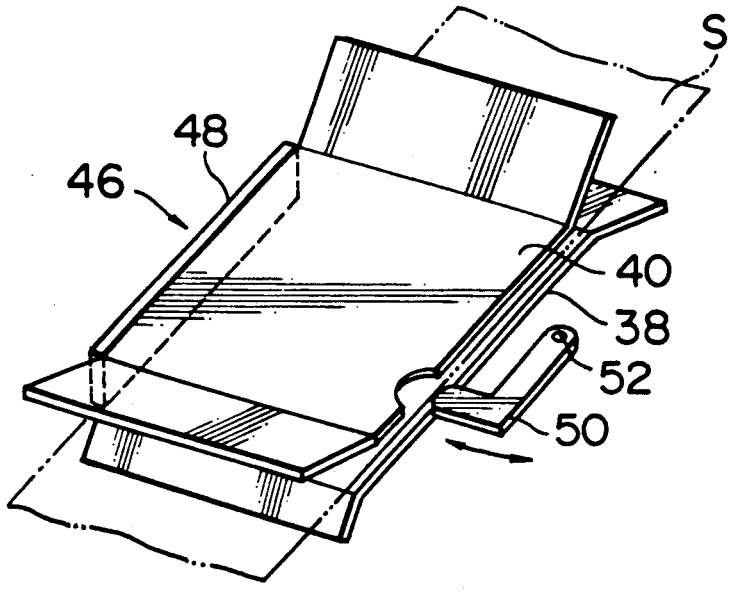
FIG. 5 is an enlarged perspective view of the lateral sheet readjustment mechanism in the printer of FIG. 1.

As illustrated on an enlarged scale in FIG. 5, the lateral sheet readjustment mechanism 46 comprises the noted pair of fixed sheet guides 38 and 40 which are per se conventional in the art. The readjustment mechanism 46 additionally comprises a fixed side abutment 48 extending along one side of the pair of fixed sheet guides 38 and 40 in right angular relationship to the retractable end abutment 44. Also included is a sheet pusher 50 disposed on the other side of the fixed sheet guide pair for pushing the recipient sheet S, standing endwise on the end abutment 44, into neat contact with the side abutment 48. The sheet pusher 50 is herein shown pivoted at 52 for angular movement in the plane of the recipient sheet S traveling between the fixed sheet guides 38 and 40. A suitable drive mechanism, such as that comprising an electric motor or a solenoid, may be provided for such angular movement of the sheet pusher 50.

Despite the showing of FIG. 5, however, the provision of the sheet pusher 50 is not essential. Alternatively, the sheet guides 38 and 40, retractable end abutment 44 and fixed side abutment 48 may be so inclined that each recipient sheet will come into close contact with the side abutment under its own weight on standing endwise on the end abutment. As an additional alternative, vibrations may be imparted to the sheet readjustment mechanism 46, exclusive of the sheet pusher 50, for urging the recipient sheet into contact with the side abutment.

Figure 4:
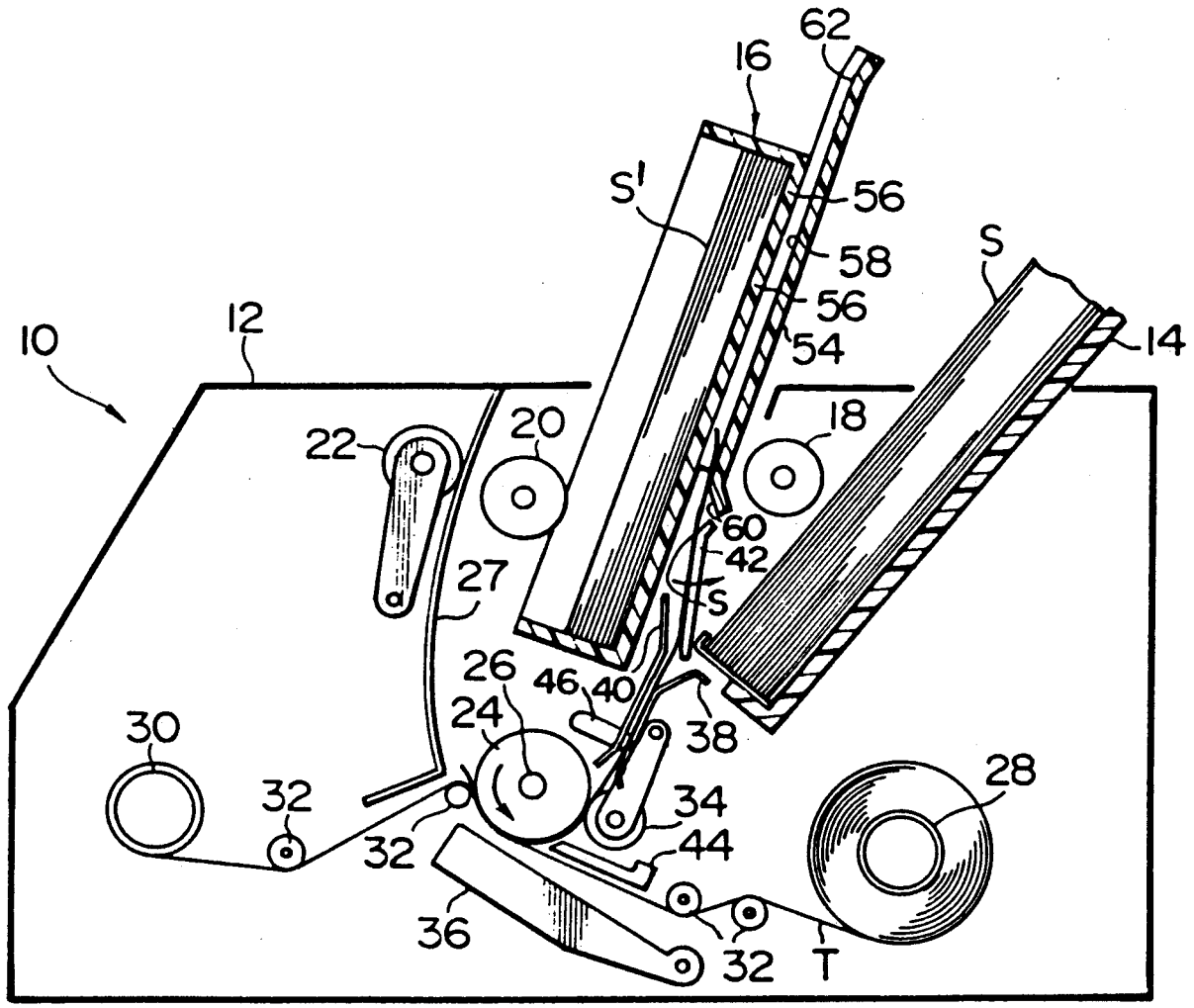
Figure 6:
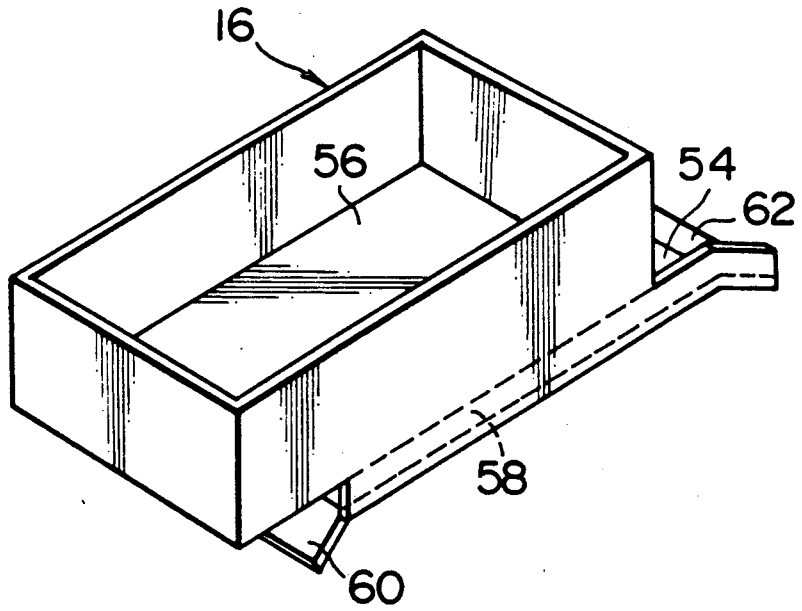
FIG. 6 is a perspective view of the unloading cassette, complete with means defining a sheet guideway on its back, in the printer of FIG. 1.

As illustrated in perspective in FIG. 6, the unloading cassette 16 is formed in one piece with a flat sheet guide 54 extending in parallel spaced relation to the bottom 56 of the unloading cassette to define a sheet guideway 58 therebetween. When the movable sheet guide 42 is in the working position as shown in FIG. 4, the sheet guideway 58 serves as part of the return path for the recipient sheet S being printed upon. An angled lip 60 is formed at on end of the sheet guide 54 to expedite the entrance of the recipient sheet S into the sheet guideway 58 via the movable sheet guide 42.

The sheet guideway 58 is intended to serve the additional purpose of permitting manual insertion of a recipient sheet into the printer 10. Toward this end the sheet guide 54 has another angled lip 62 on its manual insertion end projecting from within the printer casing 12. When the movable sheet guide is in the retracted position of FIG. 4, a recipient sheet may be manually inserted in the sheet guideway 58 through the manual insertion end into abutting engagement with the retractable end abutment 44.

Figure 7:
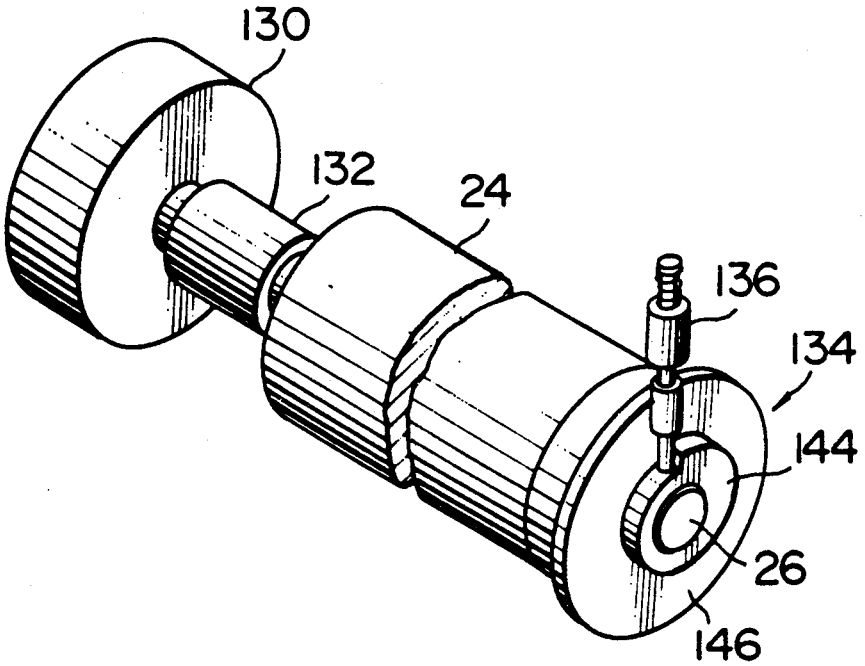
FIG. 7 is an enlarged perspective view, partly shown broken away for illustrative convenience, of the platen roll in the printer of FIG. 1, the platen roll being shown together with its positioning mechanism and a rotary encoder coupled thereto.

As illustrated on an enlarged scale in FIG. 7, a rotary encoder 130 is conventionally mounted to the drive shaft 26 of the platen roll 24 via a coupling 132. With the rotation of the platen roll 24, the encoder 130 generates a train of electric pulses at a rate of, for example, one per platen revolution and another pulse train at a rate of 1500 per platen revolution. These pulse trains are utilized in a known manner for the determination of the angular position of the platen roll and for controlling the printing operation to be detailed subsequently.

Figure 8:
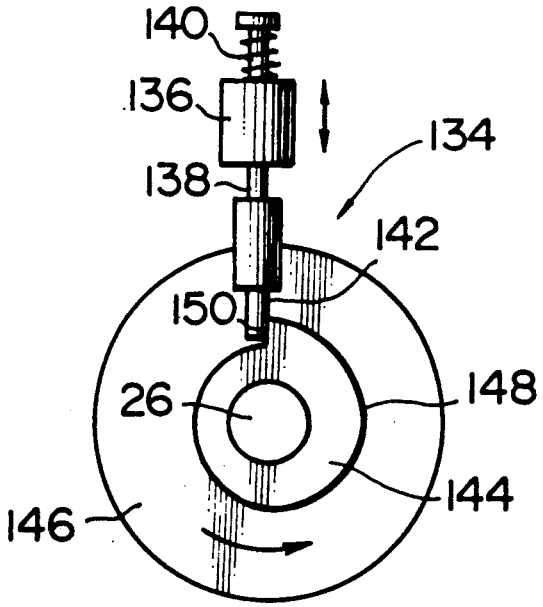
FIG. 8 is an enlarged end elevation of the platen roll of FIG. 7, showing in particular the platen positioning mechanism.

Preferably, and as shown in both FIGS. 7 and 8, the platen roll 24 may be provided with a positioning mechanism 134 thereby to be positioned in a preassigned starting angular position as required. The platen positioning mechanism 134 includes a linear actuator shown as a solenoid 136 having a plunger 138 and a return spring 140. The plunger 138 is terminated at one end by a detent 142 for movement into and out of both sliding and positive engagement with a boss 144 formed on a flange 146 on one end of the platen roll 24. The boss 144 has its periphery shaped to provide a spiral cam surface 148 and an abutment 150 extending substantially radially of the platen roll 24.

In both FIGS. 7 and 8 is shown the solenoid 136 energized to thrust the plunger 138 toward the boss 144 against the force of the return spring 140, with the consequent positive engagement of the detent 142 with the abutment 150. The platen roll 24 is then held in the starting position and locked against rotation in the reverse direction indicated by the arrow in FIG. 8. A more detailed discussion of the operation of the platen positioning mechanism 134 will appear in the course of the following description of the printer operation.

OPERATION

Figure 9:
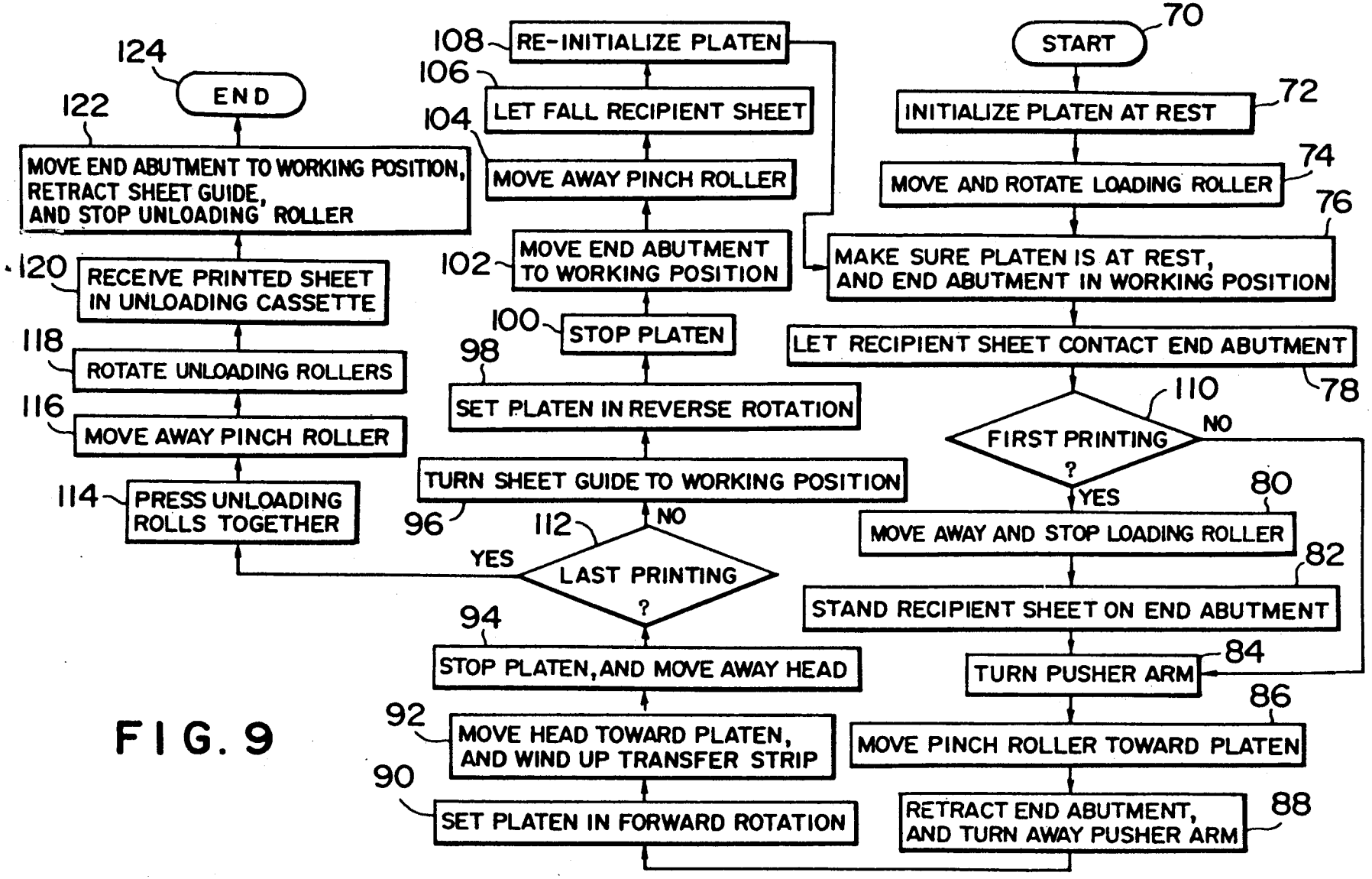
FIG. 9 is a flowchart of the normal printing routine of the FIG. 1 printer.

The operation of the color printer 10 can be fully automated and controlled according to the flowchart of FIG. 9. This flowchart will therefore be referred to throughout the following operational description for a better understanding of such description.

The loading cassette 14, with the stack of recipient sheets S received therein, and the unloading cassette 16 may be mounted in position on the color printer 10 preparatory to the commencement of printing operation. Then, as the printer 10 is electrically turned on, the various working parts of the printer will be initialized in the positions depicted in FIG. 1, with the platen roll 24 held in the prescribed starting position (blocks 70 and 72 in the flowchart of FIG. 9).

The platen roll 24 may be initialized in the starting position through the following procedure if it has not been in that position when a printing command is input to the unshown electronic control system of the printer at the block 70 of the flowchart. The solenoid 136 may first be energized for moving the detent 142 into abutting contact with the cam surface 148 of the boss 144 on the platen roll 24. Then the platen roll 24 may be set into rotation in the reverse direction, indicated by the arrow in FIG. 8, at relatively high speed. The detent 142 will relatively slide over the cam surface 148 toward the abutment 150. The platen roll 24 may be switched to low speed rotation shortly before the detent 142 engages the abutment 150. It is understood that the control system always knows the angular position of the platen roll 24 from the trains of pulses generated by the encoder 130. It is therefore easy to switch the platen roll 24 from high to low speed rotation in a predetermined angular position shortly before the abutment 150 comes into engagement with the detent 142.

As required, the drive motor for the platen roll 24 may be held weakly energized for rotation in the reverse direction after the abutment 150 has come into engagement with the detent 142, in order to prevent any accidental angular displacement of the platen roll in the forward direction.

Then the loading roller 18 may be moved into frictional contact with the stack of recipient sheets S within the loading cassette 14 and set into rotation (block 74). The topmost one of the recipient sheets S within the loading cassette 14 will thus be withdrawn therefrom and fed forwardly along the predetermined sheet path defined by the pair of fixed sheet guides 38 and 40.

It is understood that the pinch roller 34 is now in the position away from the platen roll 24, and that the retractable end abutment 44 is in the working position close to the platen roll, both as shown in FIG. 1. Therefore, traveling between platen roll 24 and pinch roller 34, the recipient sheet S will come endwise into contact with the retractable end abutment 44 (blocks 76 and 78). FIG. 2 illustrates this state. Then the loading roller 18 may be moved out of frictional contact with the recipient sheet stack within the loading cassette 14 and set out of rotation (block 80). Thereupon the first recipient sheet S will stand on the end abutment 44, with the leading end of the sheet readjusted into neat contact with the end abutment under its own weight (block 82).

Then the pusher arm 50 of the lateral sheet readjustment mechanism 46, FIG. 5, may be pivoted toward the pair of fixed sheet guides 38 and 40 for pushing the first recipient sheet S toward the fixed side abutment 48 (block 84). So pushed, the first recipient sheet S will slide over the end abutment 44 into neat contact with the side abutment 48. Now the first recipient sheet S has been correctly positioned with respect to the platen roll 24.

Then the pinch roller 34 may be pivoted for pressing the first recipient sheet S against the platen roll 24 (block 86). Then both end abutment 44 and pusher arm 50 may be retracted (block 88).

Then the platen roll 24 may be set into rotation for feeding the first recipient sheet S until its leading end portion becomes caught between the platen roll and the color transfer strip T (block 90).

Figure 3:
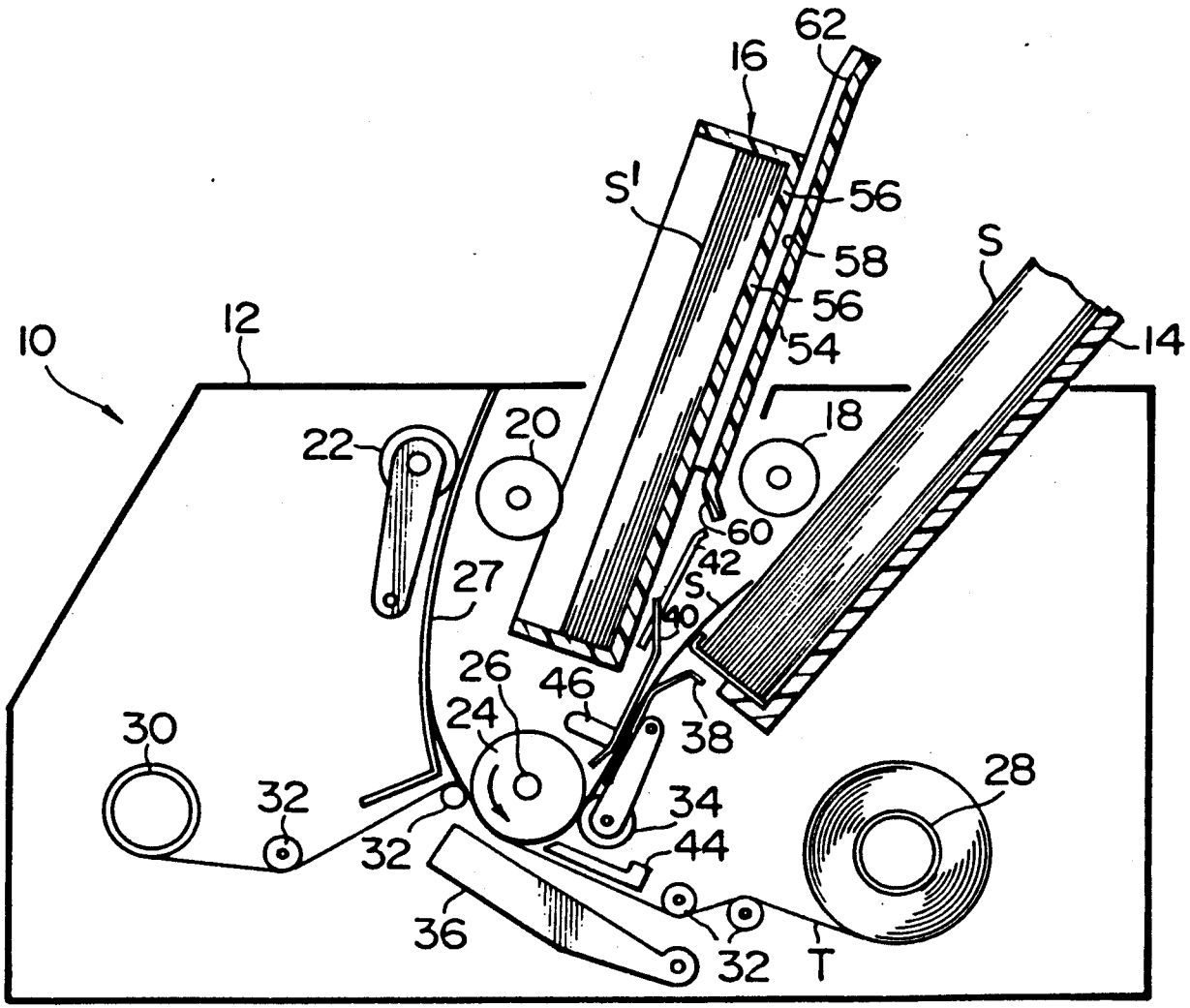

Then the thermal printing head 36 may be pivoted for pressing the transfer strip T and first recipient sheet S against the platen roll 24. The first monochrome image (e.g. yellow) will be transferred from transfer strip T to recipient sheet S as a printing signal is conventionally supplied to the printing head 36 while the transfer strip and the recipient sheet are jointly traveling forwardly as illustrated in FIG. 3 (block 92). The recipient sheet S will travel along the arcuate sheet guide 27 toward the unloading cassette 16 whereas the transfer strip T will be wound up on the takeup reel 30.

Then, upon completion of the thermal transfer of the first monochrome image to the recipient sheet S, the platen roll 24 may be set out of rotation, and the printing head 36 may be pivoted away from the platen roll (block 94). The pinch roller 34 should be left urging the recipient sheet S against the platen roll 24.

Then the movable sheet guide 42 may be pivoted from the retracted position of FIGS. 1–3 to the working position of FIG. 4 (block 96). Then the platen roll 24 may be set in reverse rotation for feeding the recipient sheet S rearwardly along the return path of FIG. 4 at a speed several times higher than during printing (block 98). It will be noted from FIG. 4 that the recipient sheet partly enters the sheet guideway 58 on the back of the unloading cassette 16 on being thus fed back along the return path. The platen roll 24 may be set out of rotation shortly after the trailing end of the recipient sheet S has traveled past the retractable end abutment 44, which is now held retracted as shown in FIG. 4 (block 100).

Then the end abutment 44 may be moved back to the working position (block 102), and the pinch roller 34 may be moved away from the platen roll 24 (block 104). Thereupon, released from between platen roll 24 and pinch roller 34, the recipient sheet will fall by gravity on the end abutment 44 (block 106).

The next step is the re-initialization of the platen roll 24 to the starting position (block 108). The platen roll has overrun the starting position when its high speed reverse rotation is arrested at the block 100. The platen roll may therefore be driven forwardly through a relatively small angle to the predetermined position in which the platen roll was switched from high to low speed rotation during the initialization at the start of printing operation. Then the solenoid 136 may be energized to move the detent 142 into sliding engagement with the cam surface 148 of the boss 146 on the platen roll. Then the platen roll may be driven reversely at low speed until the abutment 150 comes into engagement with the detent 142.

Thus, even though the recipient sheet S is temporarily released from the platen roll 24 during the progress of color printing, the platen roll can be automatically readjusted to the exact starting position while the recipient sheet is standing on the end abutment 44. Such exact readjustment of the angular position of the platen roll serves for the enhancement of color registration as the color printing operation is controlled as aforesaid on the basis of the output pulses of the encoder 130 coupled t the platen drive shaft 26.

The printing operation proceeds from block 108 to block 76 in the flowchart of FIG. 9. At a logical node 110 which follows the block 78, it is determined if the recipient sheet S is being subsequently put to the first printing of color reproduction or not. Since the recipient sheet is now being put to the second printing, the blocks 80 and 82 are bypassed, and the pusher arm 50 is immediately actuated to push the recipient sheet into neat contact with the side abutment 48 (block 84).

Then the procedure of the blocks 84–94 is followed to complete the printing of the second monochrome image on the recipient sheet S.

When the printing of the last (e.g. fourth) monochrome image (e.g. black) is completed at the block 94 by the repetition of the foregoing procedure, this fact is ascertained at a logical node 112. Then the unloading roller 22 is actuated to press the printed recipient sheet S against the other unloading roller 20 (block 114). Then the pinch roller 34 may be moved away from the platen roll 24 (block 116). Then the unloading roller 20 may be set into rotation with the other unloading roller 22 for moving the printed recipient sheet S into the unloading cassette 16 via the arcuate sheet guide 27 (blocks 118 and 120). Then the color printer 10 may be initialized, as shown in FIG. 1, pending the next command for the start of printing (blocks 122 and 124).

For manual insertion of a recipient sheet in the color printer 10, a "manual" command may be input to the unshown electronic control system after the printer has been initialized as at the block 72 in FIG. 9. Thereupon the movable sheet guide 42 will turn to the working position of FIG. 4. Then a recipient sheet S may be inserted in the guideway 58 on the back of the unloading cassette 16. Then, guided by the movable guide 42 and the pair of fixed guides 38 and 40, the recipient sheet will fall into contact with the retractable end abutment 44 and stand endwise thereon. This state is equivalent to the block 82 in FIG. 9. Thereafter the procedure of FIG. 9 may be followed to print the required number of monochrome images on the recipient sheet that has been inserted manually a above.

SECOND FORM

Figure 10:
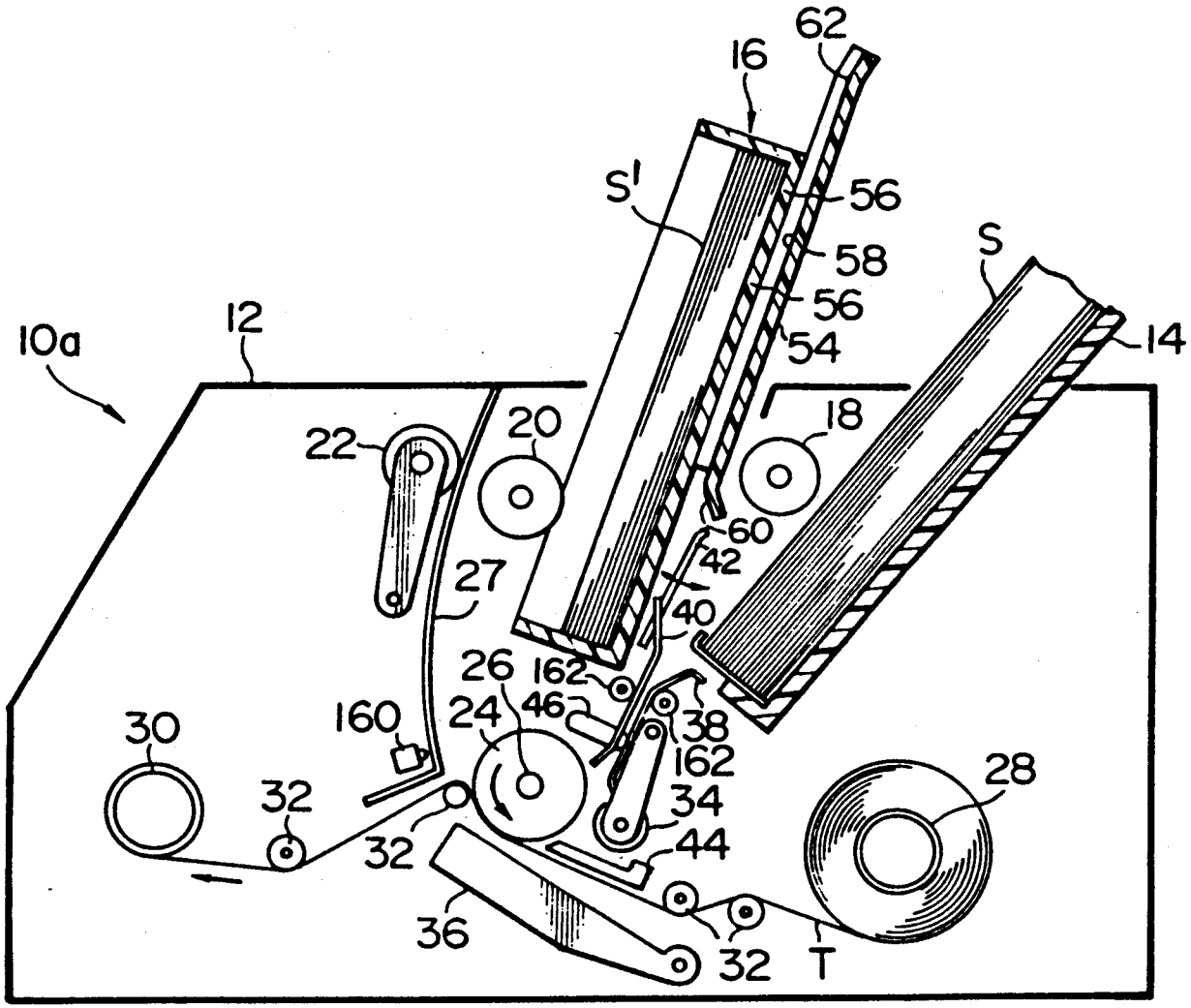
FIG. 10 is a view similar to FIG. 1 but showing another preferred embodiment of the invention.

The second preferred form of color printer according to the present invention is shown in FIG. 10 and therein generally designated 10*a*. The alternative color printer 10*a* features a sheet detector 160, such as in the form of a photodetector, disposed in a preassigned position between platen roll 24 and unloading cassette 16 for detecting the leading end of the recipient sheet S being printed upon.

Another feature of the alternative color printer 10*a* is a pair of sheet stretch rolls 162 disposed between loading cassette 14 and platen roll 24. One of the stretch rolls 162 is movable toward and away from the other for frictionally engaging and disengaging the recipient sheet S therebetween. Despite the showing of FIG. 10, however, only one stretch roll may be provided on either side of the recipient sheet for pressing the same against the opposed one of the fixed sheet guides 38 and 40 as required.

The alternative color printer 10*a* is identical in the other details of construction with the first disclosed printer 10. The various parts of this second embodiment are therefore indicated in FIG. 10 by the same reference characters as used to denote the corresponding parts of the first embodiment.

OPERATION OF SECOND FORM

Figure 11:
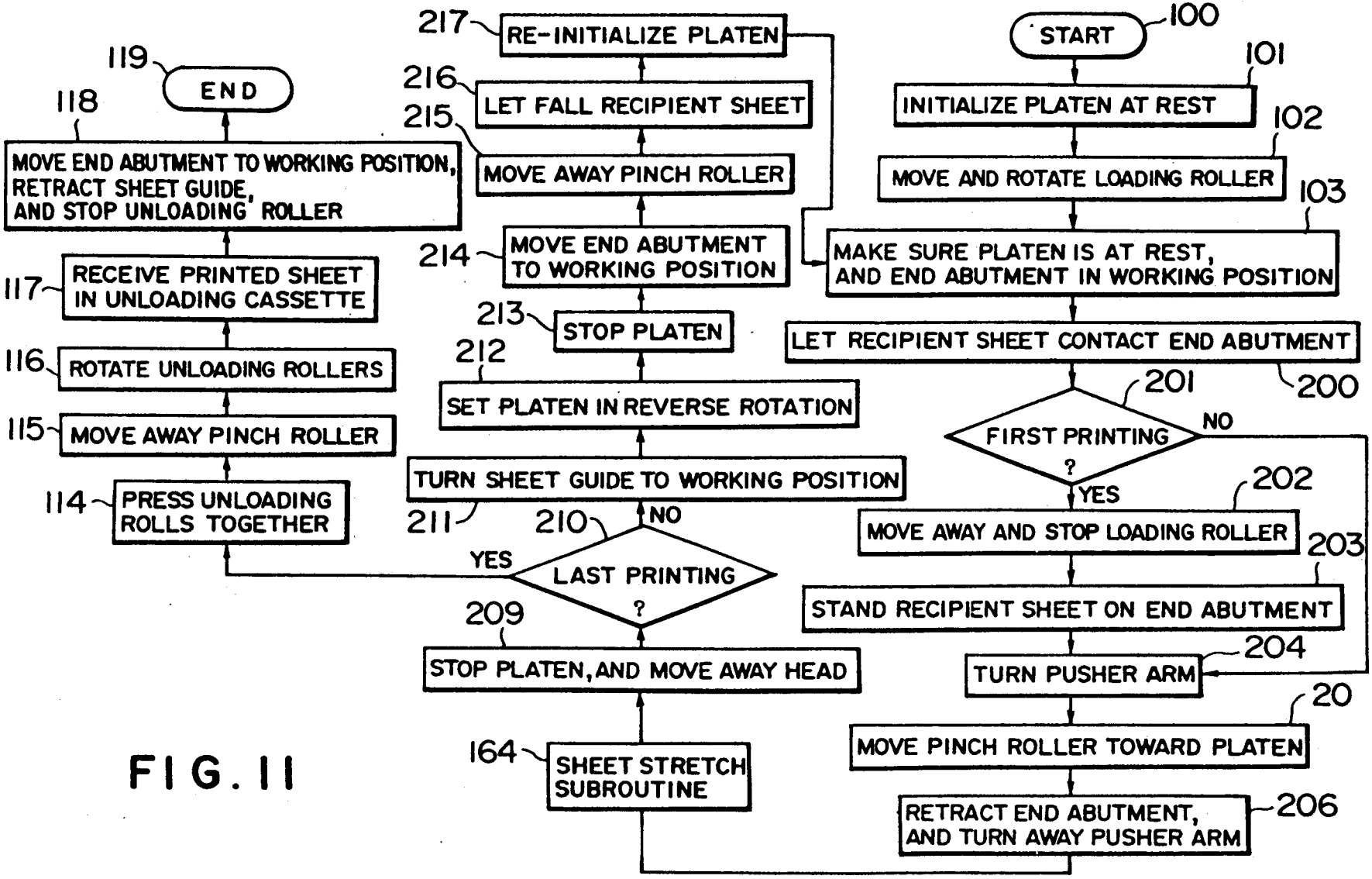
FIG. 11 is a flowchart of the printing routine of the FIG. 10 printer.
Figure 12:
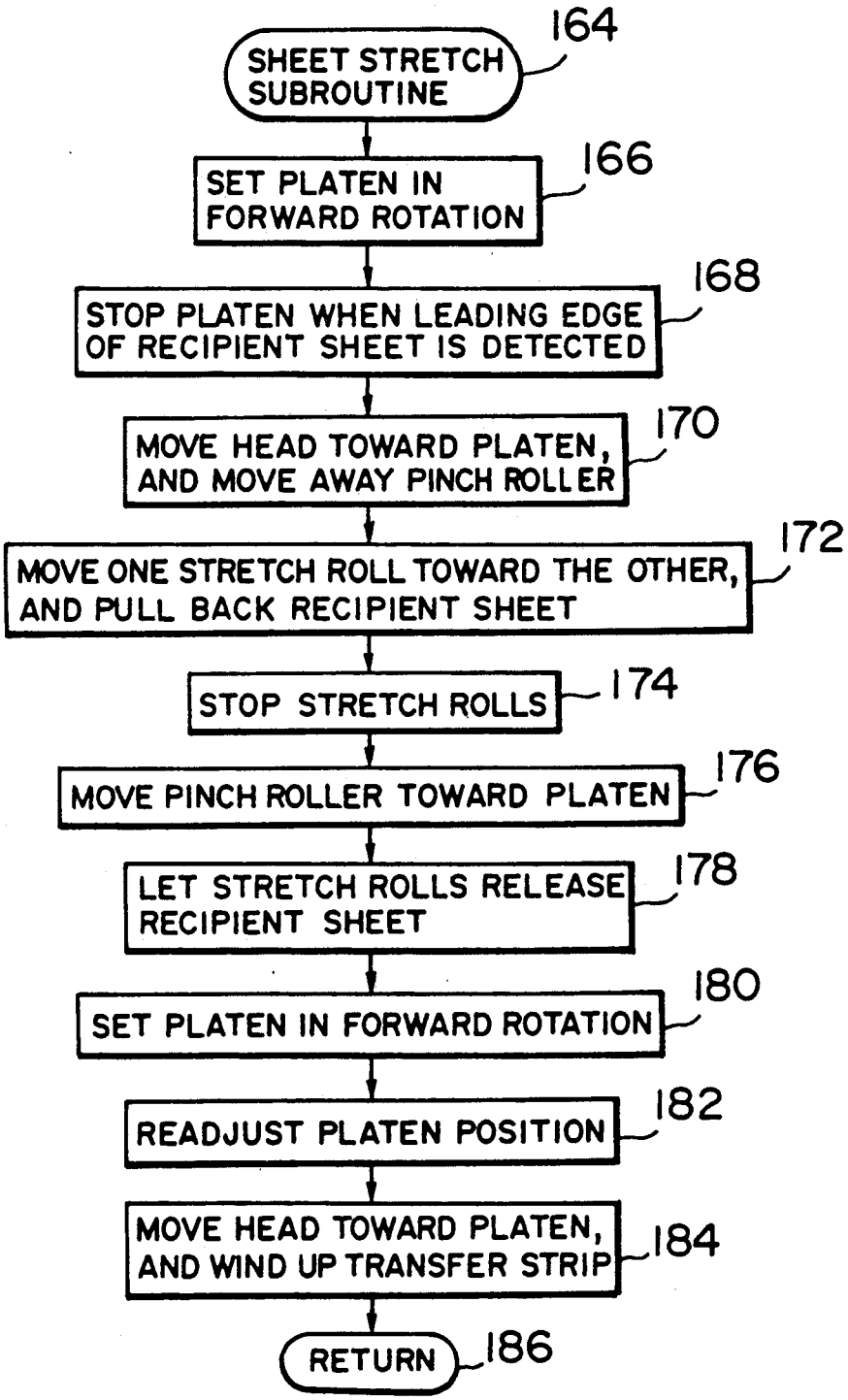
FIG. 12 is a flowchart of the sheet stretch subroutine included in the printing routine of FIG. 11.

The operation of the alternative color printer 10*a* will be best understood by referring to the flowchart of FIG. 11. A comparison of this flowchart with that of FIG. 9 will reveal that the operation of the alternative color printer 10*a* differs from that of the printer 10 only in a sheet stretch subroutine 164 interposed between the blocks 88 and 94 in substitution for the blocks 90 and 92 of the FIG. 9 flowchart. Only this sheet stretch subroutine 164 will therefore be described in detail with reference to FIG. 12.

The first recipient sheet S to be printed upon has been pressed against the platen roll 24 by the pinch roller 34 at the block 86 after having had its position readjusted at the block 84, and both end abutment 44 and pusher arm 50 have been retracted at the block 88. Then, at the first block 166 of the sheet stretch subroutine 164, the platen roll 24 is driven forwardly for feeding the recipient sheet S until its lading end is detected by the sheet detector 160 whereupon the platen roll may be set out of rotation (block 168). Then the thermal printing head 36 may be turned to press the superposed recipient sheet S and transfer strip T against the platen roll 24, and the pinch roller 34 may be moved away from the platen roll (block 170).

Then one of the sheet stretch rolls 162 may be moved toward the other for frictionally engaging the recipient sheet S therebetween and then driven rearwardly to pull back the recipient sheet and hence to take up its slack (block 172). The reverse energization of the stretch rolls 162 may be discontinued approximately when the recipient sheet is fully stretched between the stretch rolls and the printing head 36 (block 174). The frictional force exerted on the recipient sheet by the stretch rolls 162 may be made less than that exerted thereon by the platen roll 24 and printing head 36, in order that the recipient sheet may not slip over the platen roll if the stretch rolls remain in reverse rotation after the recipient sheet has been fully stretched.

Then, with the recipient sheet S held fully stretched upstream of the platen roll 24, the pinch roller 34 may be moved to press the recipient sheet against the platen roll (block 176). Then the platen roll 24 may be set into forward rotation after moving the stretch rolls 162 away from each other (block 178 and 180). The printing of the first monochrome image of a desired color reproduction may be started when the platen roll 24 reaches the preassigned angular position as ascertained from the output pulses of the encoder 130, FIG. 7 (blocks 182 and 184). The sheet stretch subroutine ends at the block 186, and the main color printing routine restarts at the block 94 of FIG. 9.

Thus, in this alternate embodiment of the present invention, the slack of the recipient sheet is taken up preparatory to each printing of a monochrome image. The elimination of the slack contributes toward greater enhancement of color registration because the recipient sheet has heretofore tended to extend over the platen roll with variable degrees of looseness from one monochrome printing operation to another.

Even though the sheet detector 160 detects the leading end of the recipient sheet in the same position before each monochrome printing operation, the platen roll 24 will not necessarily be in the same angular position because of the variable degrees of sheet slack. The angular position of the platen roll must therefore be readjusted. Toward this end the data representative of the required starting position of the platen roll may be stored in a suitable memory or storage device included in the electronic control system of the color printer 10*a*. The platen position signal produced by the encoder 130 when the leading end of the recipient sheet is detected by the sheet detector 160 may be compared with the stored starting position data, and the platen roll may be revolved through an angle corresponding to the difference therebetween, as at the block 182 in the sheet stretch subroutine of FIG. 12. Each monochrome printing operation can thus be started in exactly the same angular position of the platen roll.

THIRD FORM

Figure 13:
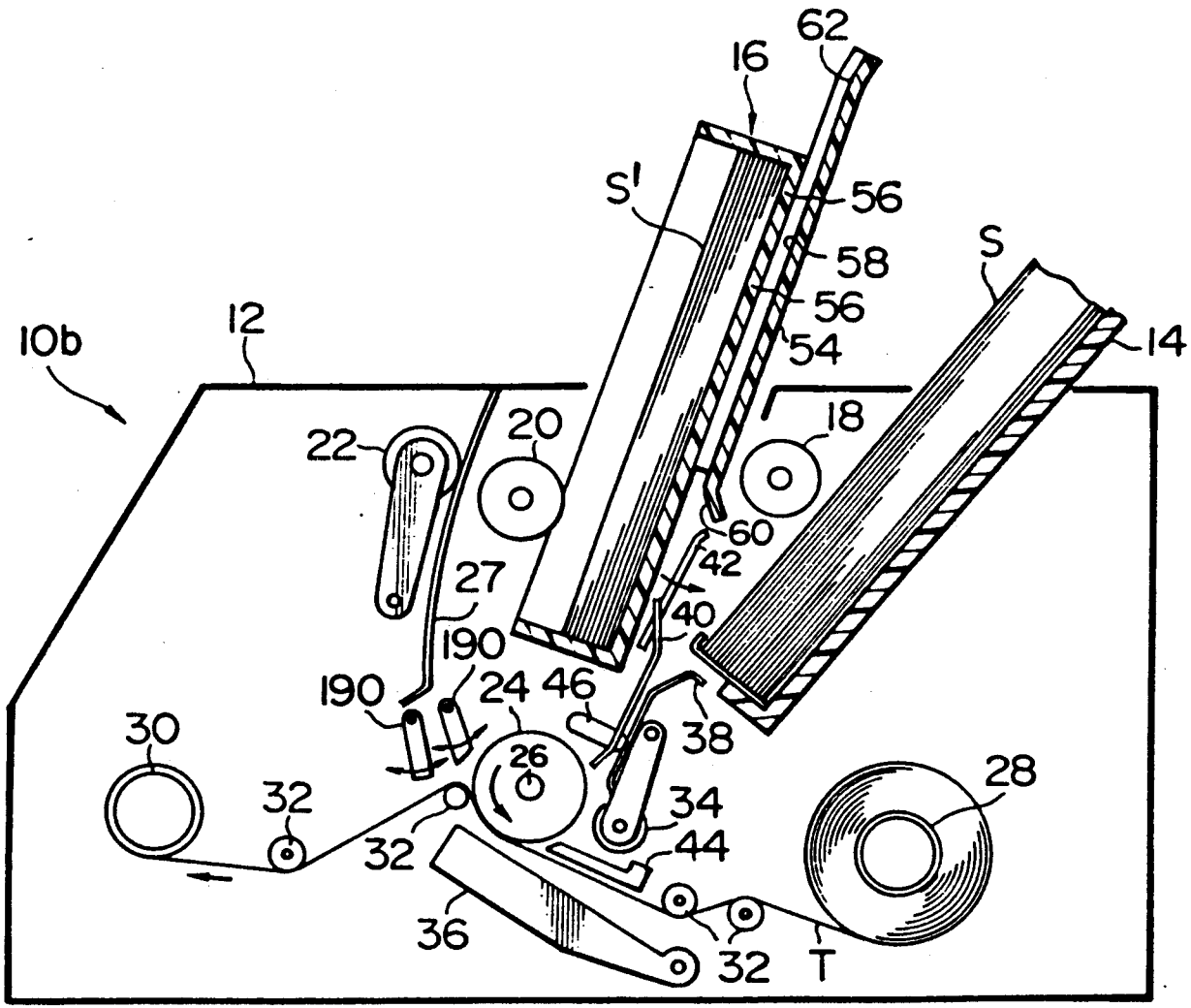
FIG. 13 is a view similar to FIG. 1 but showing still another preferred embodiment of the invention.

In FIG. 13 is shown another alternative form of color printer 10*b* in accordance with the invention. The color printer 10*b* employs a pair of sheet catcher arms 190 disposed between platen roll 24 and unloading cassette 16, instead of the pair of sheet stretch rolls of the FIG. 10 color printer 10*a*. Each pivoted at one end, the sheet catcher arms 190 are swingable toward and away from each other for frictionally engaging and disengaging the recipient sheet S being printed upon. When pivoted away from each other, the sheet catcher arms 190 do not interfere with the travel of the recipient sheet from platen roll 24 to unloading cassette 16.

The second alternative color printer 10*b* is identical in the other details of construction with the first disclosed printer 10. The various parts of this third embodiment are therefore indicated in FIG. 13 by the same reference characters as used to denote the corresponding parts of the first embodiment.

OPERATION OF THIRD FORM

Figure 14:
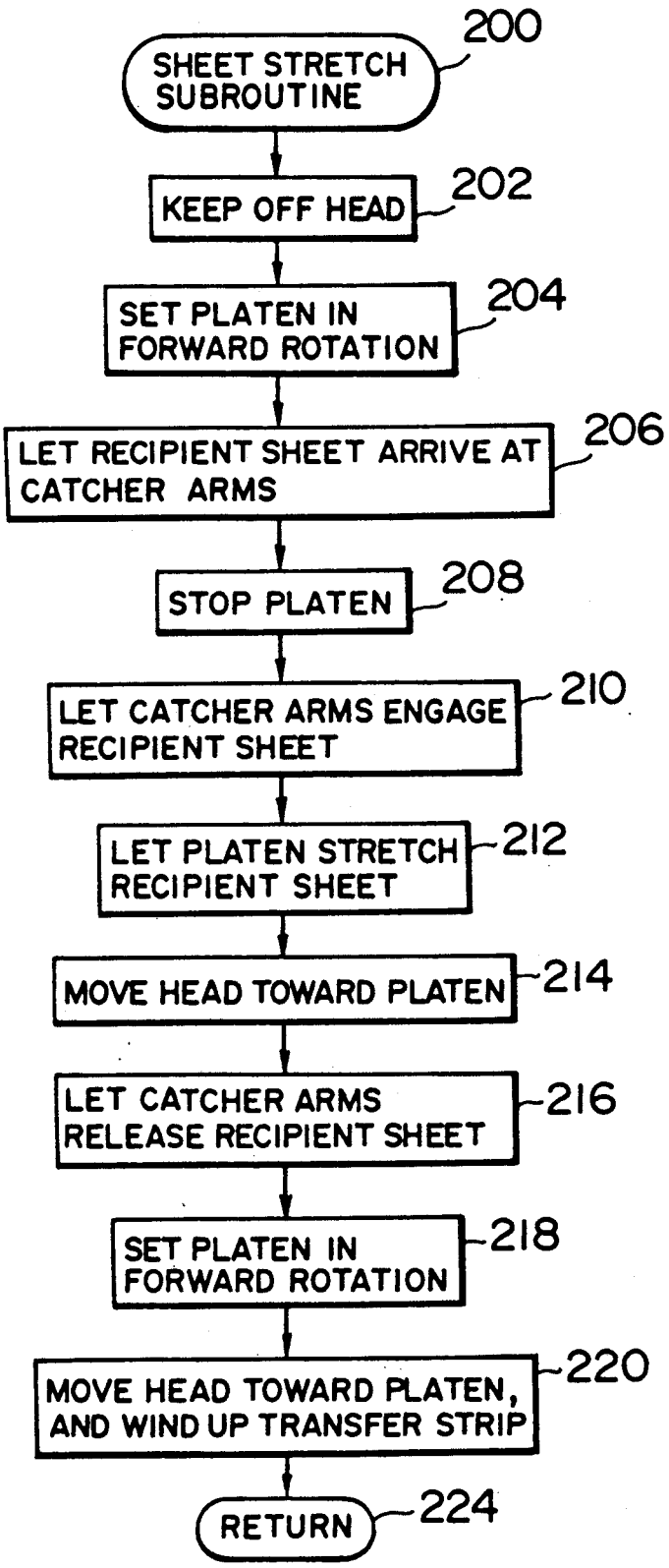
FIG. 14 is a flowchart of the sheet stretch subroutine of the FIG. 13 printer.

The operation of the second alternative color printer 10*b* is similar to that of the first alternative device 10*a* only in the sheet stretch subroutine in the flowchart of FIG. 11. The sheet stretch subroutine of the printer 10*b* is charted in FIG. 14 and therein designated 200.

As has been mentioned in connection with the first alternative printer 10*a*, the recipient sheet S has been pressed against the platen roll 24 by the pinch roller 34 after having had its position readjusted at the block 84, and both end abutment 44 and pusher arm 50 have been retracted, just before the sheet stretch subroutine 200. Then, with the start of the sheet stretch subroutine 200, the platen roll 24 is driven forwardly, with the thermal printing head 36 held slightly spaced therefrom, for feeding the recipient sheet S until its leading end arrives at a position between the pair of sheet catcher arms 190 (blocks 202, 204 and 206). Then the platen roll may be set out of rotation (block 208). Then the pair of sheet catcher arms 190 ma be pivoted toward each other for frictionally engaging the leading end of the recipient sheet therebetween (block 210).

Then the platen roll may be driven rearwardly to pull back the recipient sheet in coaction with the pinch roller 34 thereby taking up its slack (block 212). The frictional force exerted on the recipient sheet by the pair of sheet catcher arms 190 may be made less than that exerted thereon by the platen roll 24 and pinch roller 34, in order that the recipient sheet may not slip over the platen roll even if the platen roll is held reversely energized after the recipient sheet has been fully stretched.

Then, with the recipient sheet S held fully stretched downstream of the platen roll 24, the thermal printing head 36 may be pivoted to press the recipient sheet against the platen roll (block 214). Then the pair of sheet catcher arms 190 may be pivoted away from each other for releasing the leading end of the recipient sheet (block 216). Then the platen roll 24 may be set into forward rotation (block 218). The printing of the first monochrome image of a desired color reproduction may be started when the platen roll 24 reaches the preassigned angular position as ascertained from the output pulses of the encoder 130, FIG. 7 (block 220). The sheet stretch subroutine ends at the block 224, and the main color printing routine restarts at the block 94 of FIG. 11.

The number of pulses generated by the encoder 130 until the recipient sheet arrives at the sheet catcher arms 190 at the block 206 can be predetermined. The number of encoder pulses generated during the reverse energization of the platen roll 24 for stretching the recipient sheet at the block 212 can also be predetermined at such a value that the recipient sheet somewhat slips between the sheet catcher arms 190. The number of encoder pulses generated during the forward rotation of the platen roll until printing starts at the blocks 218 and 220 can also be predetermined. Therefore, unlike the preceding embodiment, the pinch roller 34 can be held pressing the recipient sheet against the platen roll 24 during the stretching of the recipient sheet. Further, once the recipient sheet has been stretched, each monochrome printing operation can be started in exactly the same position on the sheet.

It is, of course, understood that variations may be made in the form, details and arrangements of the various parts of the printers disclosed herein, in order to conform to design preferences or to the requirements of each specific application of this invention. The following claims are intended to cover all such variations or modifications of the illustrated embodiments as will readily occur to one skilled in the art.

What is claimed is:

1. A color printer wherein a set of monochrome images of a desired color reproduction are thermally transferred from a color transfer strip to a recipient sheet as the latter is fed back and forth by and past a platen roll disposed intermediate a sheet loading station and a sheet unloading station, including a thermal printing head for pressing the transfer strip and the recipient sheet against the platen roll for thermal ink transfer, and a pinch roller movable toward and away from the platen roll for pressing the recipient sheet against the platen roll, the pinch roller being spaced upstream from the printing head with respect to the traveling direction of the recipient sheet from the loading station to the unloading station, wherein the improvement resides in means for the exact registration of the monochrome images of each color reproduction on the recipient sheet, comprising:

(a) an end abutment disposed intermediate the printing head and the pinch roller for reciprocating movement between a working position close to the platen roll and a retracted position away from the platen roll, the recipient sheet standing endwise on the end abutment being held in the working position preparatory to being fed forwardly past the platen roll for the transfer of each monochrome image; and (b) sheet readjustment means disposed upstream of the end abutment for readjusting the position of the recipient sheet, standing endwise on the end abutment, in the axial direction of the platen roll.

2. The color printer of claim 1 wherein the sheet readjustment means comprises:

(a) sheet guide means defining at least part of a path for the recipient sheet between the loading station and the platen roll;

(b) a side abutment disposed on one side of the sheet guide means and extending at a right angle to the end abutment; and (c) a sheet pusher disposed on the other side of the sheet guide means for pushing the recipient sheet, standing endwise on the end abutment, into neat contact with the side abutment.

3. The color printer of claim 1 further comprising:

(a) a rotary pulse generator coupled to the platen roll for generating pulses that are used to determine the angular position of the platen roll; and (b) positioning means for arresting the rotation of the platen roll in a preassigned angular position.

4. The color printer of claim 3 wherein the positioning means comprises:

(a) engagement means coupled to the platen roll for joint rotation therewith; and (b) detent means movable into and out of engagement with the engagement means, the detent means holding the platen roll in the preassigned angular position when moved into engagement with the engagement means.

5. The color printer of claim 4 wherein the engagement means comprises a boss formed on one end of the platen roll for joint rotation therewith and having a periphery shaped to provide a spiral cam surface and an abutment extending substantially radially of the platen roll, the detent means when moved toward the engagement means relatively sliding over the spiral cam surface of the boss, with the rotation of the platen roll in a reverse direction, into positive engagement with the radial abutment of the boss, the platen roll being locked against reverse rotation and held in the preassigned angular position upon positive engagement of the detent means with the radial abutment of the boss.

6. The color printer of claim 1 further comprising:

(a) an unloading cassette disposed at the unloading station for receiving successive printed recipient sheets; and (b) means formed in one piece with the unloading cassette and defining a sheet guideway in combination therewith, the sheet guideway forming part of a return path for the recipient sheet being fed rearwardly by the platen roll.

7. The color printer of claim 6 wherein the sheet guideway has one end adapted to serve as an entrance opening for manual insertion of a recipient sheet to be printed upon.

8. The color printer of claim 1 further comprising sheet stretch roll means disposed between the loading station and the platen roll for frictionally engaging and pulling back the recipient sheet being caught between the platen roll and the printing head, in order to take up the slack, if any, of the recipient sheet preparatory to the printing of each monochrome image.

9. The color printer of claim 8 further comprising a sheet detector disposed in a prerassigned position between the platen roll and the unloading station for detecting the leading edge of the recipient sheet being fed forwardly past the platen roll.

10. The color printer of claim 1 further comprising sheet catcher means disposed between the platen roll and the unloading station for frictionally engaging the recipient sheet which has been fed forwardly by being pressed against the platen roll by the pinch roller, the recipient sheet on being frictionally engaged by the sheet catcher means being stretched by reversing the rotation of the platen roll preparatory to the printing of each monochrome image.

11. A color printer wherein a set of monochrome images of a desired color reproduction are thermally transferred from a color transfer strip to a recipient sheet as the latter is fed back and forth by and past a platen roll disposed intermediate a sheet loading station and a sheet unloading station, including a thermal printing head for pressing the transfer strip and the recipient sheet against the platen roll for thermal ink transfer, and a pinch roller movable toward and away from the platen roll for pressing the recipient sheet against the platen roll, the pinch roller being spaced upstream from the printing head with respect to the travelling direction of the recipient sheet from the loading station to the unloading station, wherein the improvement resides in means for the exact registration of the monochrome images of each color reproduction on the recipient sheet, comprising:

an end abutment disposed intermediate the printing head and the pinch roller for reciprocating movement between a working position close to the platen roll and a retracted position away from the platen roll, the recipient sheet standing endwise on the end abutment being held in the working position preparatory to being fed forwardly past the platen roll for the transfer of each monochrome image.

* * * * *